US011565153B2

(12) United States Patent
Lin et al.

(10) Patent No.: US 11,565,153 B2
(45) Date of Patent: Jan. 31, 2023

(54) PERFORMANCE STILTS

(71) Applicants: Joe Lin, Missouri City, TX (US); Brian Liu, Houston, TX (US)

(72) Inventors: Joe Lin, Missouri City, TX (US); Brian Liu, Houston, TX (US)

( * ) Notice: Subject to any disclaimer, the term of this patent is extended or adjusted under 35 U.S.C. 154(b) by 21 days.

(21) Appl. No.: 17/213,441

(22) Filed: Mar. 26, 2021

(65) Prior Publication Data

US 2022/0305343 A1 Sep. 29, 2022

(51) Int. Cl.
*A63B 25/06* (2006.01)
*A63B 25/02* (2006.01)

(52) U.S. Cl.
CPC ..... *A63B 25/06* (2013.01); *A63B 25/02* (2013.01)

(58) Field of Classification Search
CPC ..... A63B 25/00; A63B 25/02; A63B 25/06; A63B 21/023; A63B 21/00058; A63B 21/00061; A63B 21/002; A63B 21/022; A63B 21/0407; A63B 21/05; A63B 2071/1266; A63B 25/04; A63B 25/08; A63B 25/10; A61F 5/0106; A61F 5/0111; A61F 5/0123; A61F 5/0127; A61F 2005/0132; A61F 2005/0165; Y10T 403/32557; Y10T 403/32606; F16C 11/04; E05D 11/06; A61H 2003/005; A61H 2003/0216; A61H 1/0237–0281; A61H 2201/1614; A61H 2201/1616; A61H 2201/1628; A61H 2201/163; A61H 2201/1635; A61H 2201/1638; A61H 2201/164; A61H 2201/1642; A61H 2201/165; A61H 2201/1652
USPC ..... 16/374, 375, 377
See application file for complete search history.

(56) References Cited

U.S. PATENT DOCUMENTS 4,890,607 A * 1/1990 Townsend ..... A61F 5/0123 602/26
6,517,586 B2 * 2/2003 Lin ..... A63B 25/02 482/75
6,648,803 B1 * 11/2003 Jay ..... A63B 25/00 482/76
7,744,509 B1 * 6/2010 Emmert ..... A63B 21/023 482/75
7,981,008 B1 * 7/2011 Sener ..... A63B 25/00 623/28
8,047,969 B1 * 11/2011 Jay ..... A63B 25/02 482/75

(Continued)

*Primary Examiner* — Megan Anderson
(74) *Attorney, Agent, or Firm* — John R. Casperson

(57) ABSTRACT

A stilt comprises a floor platform, a shoe platform, a first substantially vertical support, a second substantially vertical support, and a toe assembly. The shoe platform is superposed above the floor platform. The first substantially vertical support connects a front portion of the floor platform with a front portion of the shoe platform. The second substantially vertical support connects a back portion of the floor platform with a back portion of the shoe platform. The first and second substantially vertical supports connect the shoe platform and the floor platform in a parallelogram configuration. The toe assembly is hingedly connected to a front end portion of the floor platform. A spring biases the toe assembly into alignment with the floor platform. A leg support extends upwardly from the second vertical support. A calf brace is pivotally connected to an upper end portion of the leg support.

15 Claims, 7 Drawing Sheets

(56) References Cited

U.S. PATENT DOCUMENTS

| | | | | |
|---|---|---|---|---|
| 10,039,956 | B1 * | 8/2018 | Lin | A63B 21/4015 |
| 2008/0096732 | A1 * | 4/2008 | Lin | A63B 25/00 24/191 |
| 2020/0360158 | A1 * | 11/2020 | Kim | A61F 2/50 |
| 2022/0193492 | A1 * | 6/2022 | Emmert | A63B 25/00 |

* cited by examiner

PERFORMANCE STILTS

BACKGROUND OF THE INVENTION

It is desirable that stilts for industrial or live performance applications be lightweight and allow for unrestricted and as natural of a range of motion as possible while conforming to and remaining securely attached to the user.

One generally suitable type of stilts is of the general type shown in U.S. Pat. No. 5,645,515 as well as a variation of such stilts in which the capture springs mechanism is substituted with freely pivoting horizontal supports attaching to both the front and rear vertical support columns in a trapezoidal nature. Another suitable type is the "Leg brace for stilts" shown in US20070232459, especially the double side pole variation thereof.

FIELD OF THE INVENTION

It would be desirable in these and other types of stilts to provide a spring-loaded articulating toe, separate from the remainder of the floor plate, to allow for the toe to pivot toward the front support column with adequate displacement and spring resistance against the ground to approximate the natural function of the human ball of the foot joint of the trailing leg when walking or lunging. By adapting the design to the aforementioned types of stilts, the lightweight nature of a two-column stilt design by forgoing a third vertical support for toe articulation, such as seen in U.S. Pat. No. 4,570,926, while still providing the benefits afforded by the inclusion of an articulating toe, namely, allowing the user to assume a more natural range of motion while wearing the stilts, can be provided.

It would be further desirable to permit some pivot in the leg band. For example, in US20070232459 at para [0017] there is described: "The second portion protrudes from the outer surface 16 of the first portion and is longitudinally elongated and defines the passage." By tapering this passage at both top and bottom in the anteroposterior directions of the stilt such that the leg band is able to pivot about its attachment point located near the middle of the height of the leg band brace an adequate amount of play can be introduced so as not restrict the motion of the user's calf throughout the user's range of motion.

One variation of the pivoting leg band concept can be provided atop a side pole stilt design, geared towards a live performance application, featuring a two-piece side pole, where a telescoping upper outer tube located at the top of the side pole is run through the leg band brace outer passage and pivots about its attachment point axis. The height of the leg band above the foot plate is adjusted via a series of externally accessible overlapping holes between the inner/lower and upper/outer side pole tubes and is set by inserting a bolt through the desired combination of holes corresponding to the correct height for the user and fastening the bolt on the opposite face of the overlapping side poles with a lock nut.

This just-described performance stilt provides a wide range of motion, unimpeded by the spring column found in the existing "Drywall Stilt" design, and the inclusion of the articulating toe allows the wearer to take more natural strides than with flat-footed designs, reducing wearer fatigue and allowing for more natural movements. The parallel supports allow the stilt to closely follow the angle of the wearer's foot relative to their lower leg, and the pivoting leg band allows the stilt to further conform to the wearer's lower leg for enhanced comfort as well as provide an additional degree of mobility at the extreme extent of the range of motion, for example, when the wearer goes into a deep squat or lunge pose. Finally, the externally accessible side pole height adjustment via the outer rectangular tube better suits the stilt to its performance environment by providing easy access and adjustment to the height setting by a wardrobe supervisor while the wearer has the stilts on, allowing the stilts to be quickly fitted to changing cast members.

Another variation of the pivoting leg band atop a side pole design, geared towards industrial/drywaller applications, features a single piece side pole through which transverse holes located at several different heights near the top of the side pole double as the height selection of the leg band as well as the pivot and fastening point of the side pole to the leg band brace. The main difference would be the method of adjusting the height of the leg band. Because drywall stilts are typically kept and maintained by individual contractors, the side pole/leg band height adjustment will likely only be set once during initial fitting and does not need to be as conveniently outwardly accessible. Because of this difference in application, the means of adjusting the height of the pivoting leg band is kept simpler by excluding the outer tube at the top of the side pole and having a series of height adjustment holes directly on the side poles, oriented laterally near the top of the side poles in ½" spacings or so and sharing the leg band mounting bolt that also serves as the axle for the pivot point. Because the side poles enter the side channels of the leg bands directly, the channel width and depth are accordingly reduced to fit the smaller rectangular tube profile.

OBJECTS OF THE INVENTION

It is an object of this invention to provide a stilt with an articulating toe.

It is another object of this invention to provide a stilt with an articulating calf attachment.

SUMMARY OF THE INVENTION

In one embodiment of the invention, there is provided a stilt comprising a floor platform, a shoe platform, a first substantially vertical support, a second substantially vertical support, and a toe assembly. The shoe platform is superposed above the floor platform. The first substantially vertical support connects a front portion of the floor platform with a front portion of the shoe platform. The second substantially vertical support connects a back portion of the floor platform with a back portion of the shoe platform. The first and second substantially vertical supports connect the shoe platform and the floor platform in a parallelogram configuration. The toe assembly is hingedly connected to a front end portion of the floor platform. A spring biases the toe assembly downwardly.

Another embodiment of the invention provides a pair of stilts with novel calf braces for greater freedom of movement. Each stilt comprises a floor platform, a shoe platform, a first substantially vertical support, a second substantially vertical support, a first leg support, and a first calf brace pivotally connected to an upper end portion of the first leg support. The shoe platform is superposed above the floor platform. The first substantially vertical support connects a front portion of the floor platform with a front portion of the shoe platform. The second substantially vertical support connects a back portion of the floor platform with a back portion of the shoe platform. The first and second substantially vertical supports connect the shoe platform and the floor platform in a parallelogram configuration. The first leg support is mounted to the second substantially vertical support and extends upwardly.

Another embodiment of the invention provides a calf brace for a stilt. The calf brace comprises a band portion that has a concave surface and a convex surface and defines a generally vertically oriented capture tunnel. The generally vertically oriented capture tunnel has a generally rectangular cross section in the horizontal plane with inner and outer parallel walls and front and back walls that converge toward a center portion of the capture tunnel. The front wall has a lower portion that is parallel to an upper portion of the back wall, and an upper portion that is parallel to a lower portion of the back wall.

DETAILED DESCRIPTION OF THE INVENTION

Figure 1:
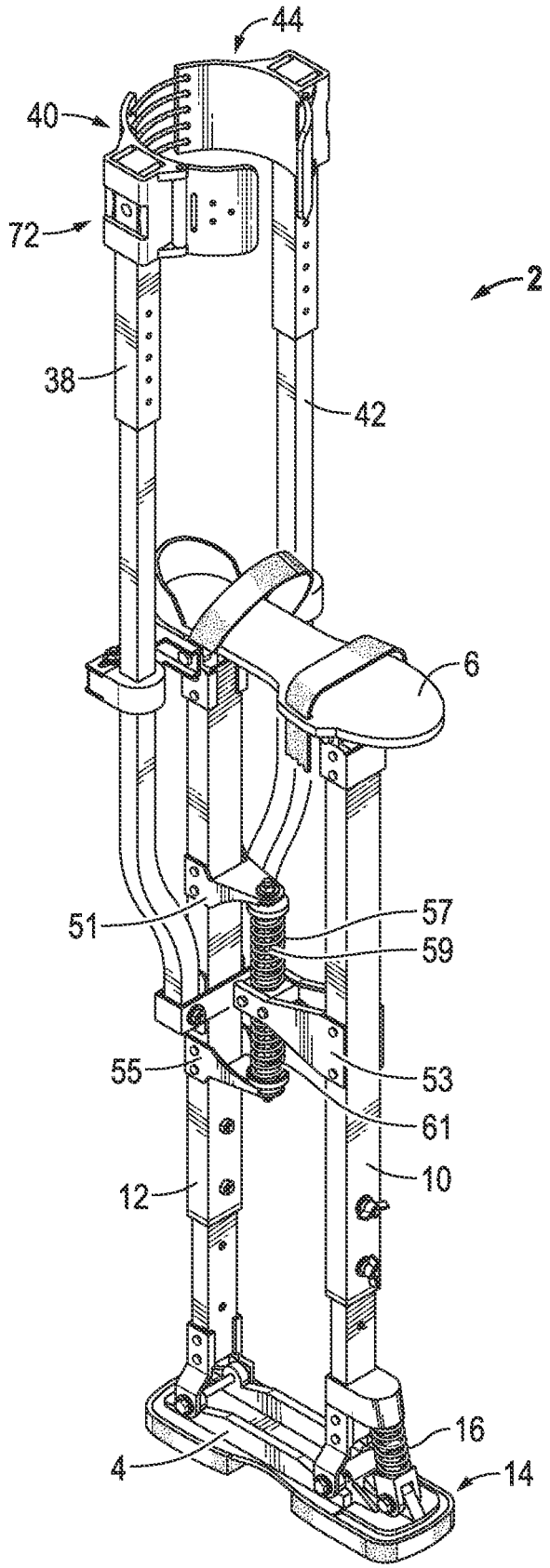
FIG. 1 is a pictorial illustration of one embodiment of the invention.
Figure 2:
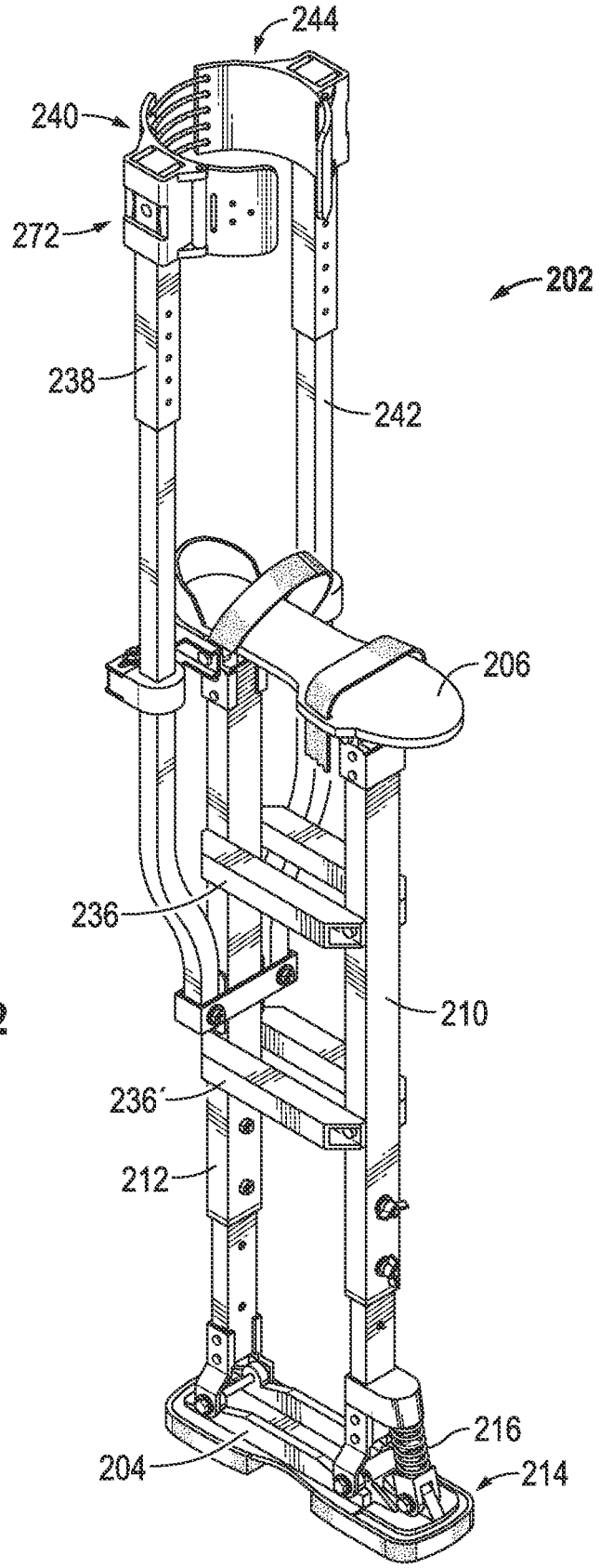
FIG. 2 is a pictorial illustration of another embodiment of the invention.

With reference to FIGS. 1 and 2, a stilt 2, 202 comprises a floor platform 4, 204 a shoe platform 6, 206, a first substantially vertical support 10, 210, a second substantially vertical support 12, 212 and a toe assembly 14, 214. The shoe platform is superposed above the floor platform. The first substantially vertical support connects a front portion of the floor platform with a front portion of the shoe platform. The second substantially vertical support connects a back portion of the floor platform with a back portion of the shoe platform. The first and second substantially vertical supports connect the shoe platform and the floor platform in a parallelogram configuration. The toe assembly 14, 214 is hingedly connected to a front end portion of the floor platform. A spring 16, 216 or other biasing means biases the toe assembly downwardly.

Figure 5:
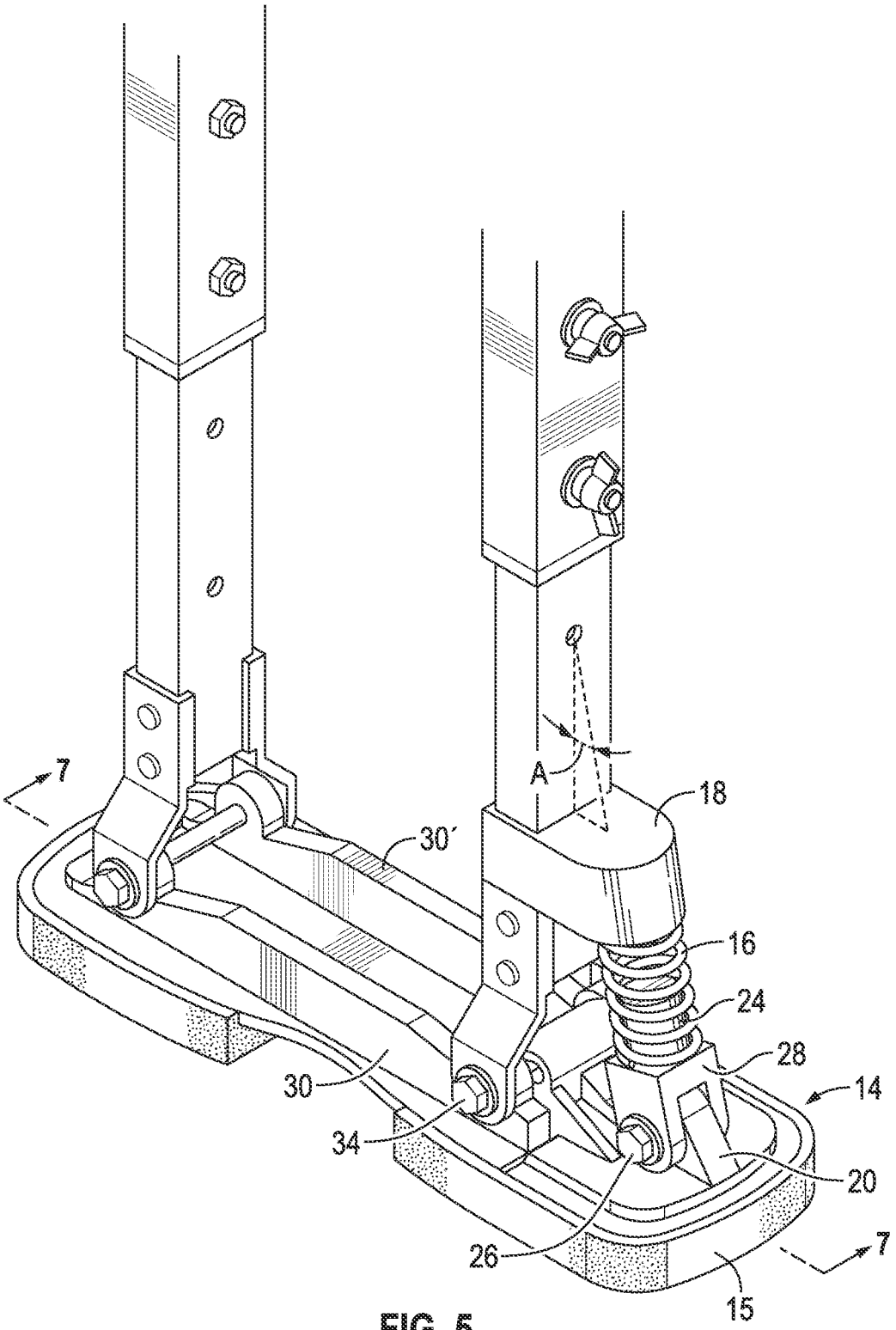
FIG. 5 is a detailed view of another portion of the invention of FIG. 1.
Figure 6:
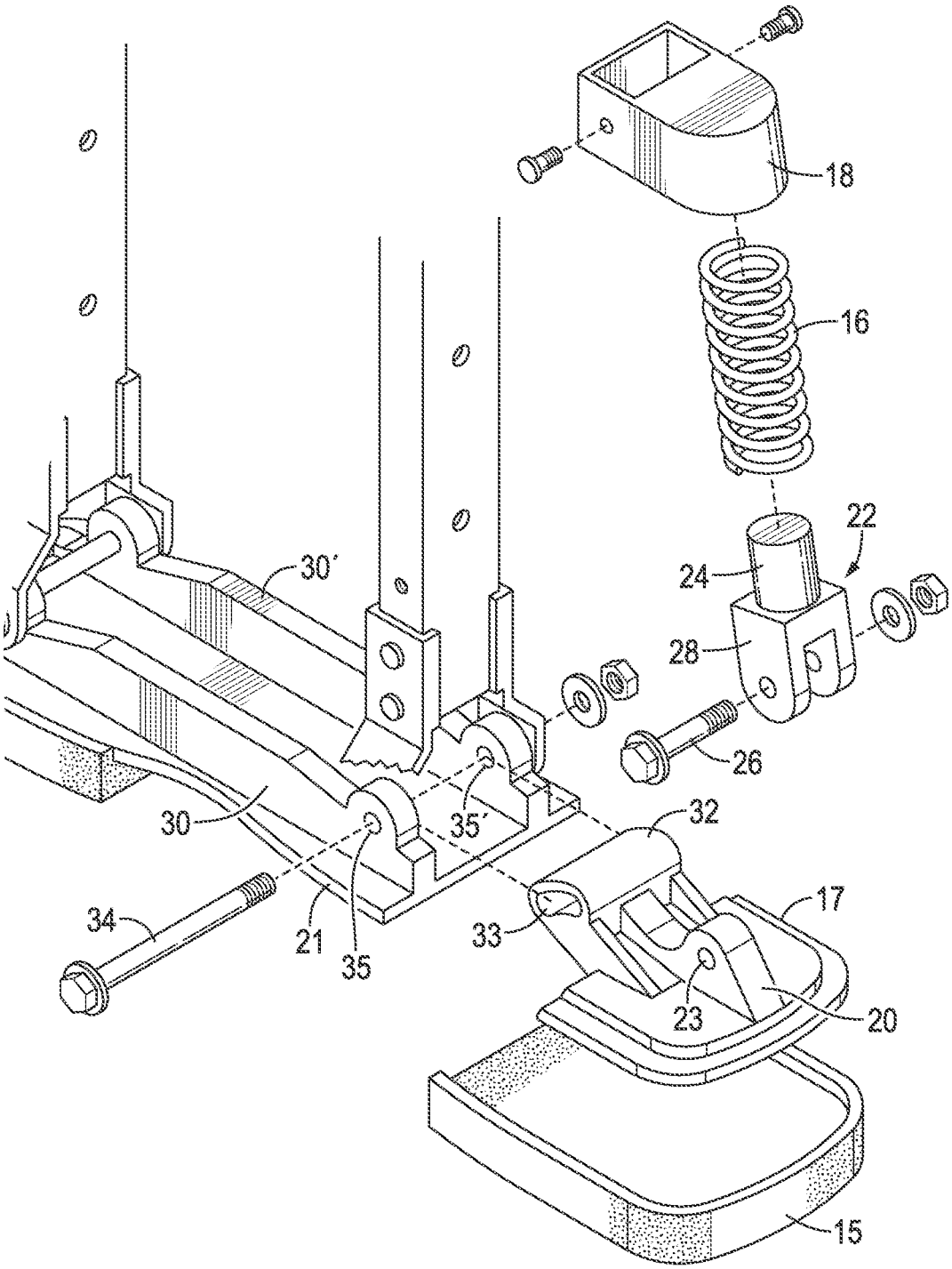
FIG. 6 is an exploded view of the portion of the invention of FIG. 5.
Figure 7:
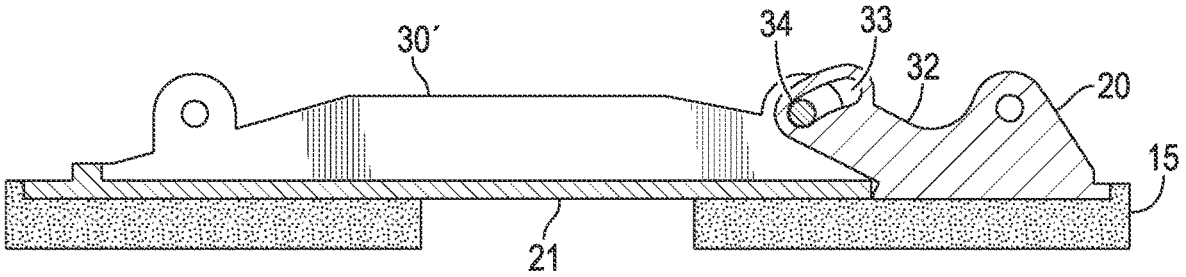
FIG. 7 is a sectional view of a portion of the invention shown in FIG. 5, illustrating the toe in a first position.
Figure 8:
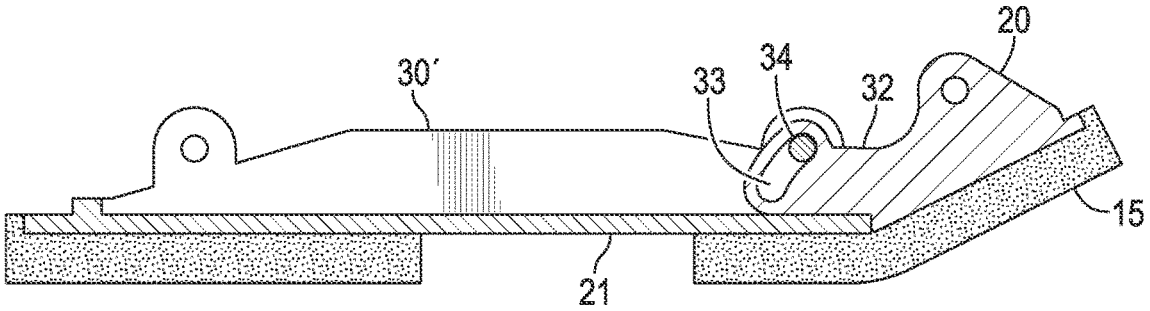
FIG. 8 is a sectional view of a portion of the invention as shown in FIG. 7, illustrating the toe in a second position.

With reference to FIGS. 5 and 6, the toe assembly preferably comprises a sole element 15 and an upper element 17. The upper element is mounted on the sole element. The sole element is preferably made of a skid resistant material such as a rubbery material and the upper element is preferably made of metal such as aluminum or magnesium but can also be made of engineering polymer. Upwardly extending features of the toe assembly are preferably formed by the upper element of the toe assembly. The sole element is secured to the upper element by any suitable means, such as by adhesives, fasteners, or by locking interfit, not shown. The sole element is preferably attached to lower surfaces of both the upper element 17 of the toe assembly and a lower plate portion 21 of the floor platform.

With reference to FIGS. 5 and 6, In a preferred embodiment, a bracket 18 extends from the first substantially vertical support in superposition with the toe assembly and the spring comprises a coil spring that biases upwardly against the bracket and downwardly against the upper element of the toe assembly. In a further preferred embodiment, a rib 20 extends upwardly from the upper element of the toe assembly and has a transverse borehole 23 therethrough. A pivoting support 22 having a transverse passage therethrough is positioned so that the passage is in alignment with the transverse borehole through the rib. The pivoting support includes a nose piece 24 protruding toward the bracket. A fastener 26 is positioned through borehole and the transverse passage in the pivoting support to pivotally attach the support to the rib. The nose piece locates the coil spring.

In one embodiment, the support is part of a fork 28 which straddles the rib at a location over the borehole. The fork comprises a pair of parallel supports each having a transverse passage therethrough in alignment with the borehole and the fastener extends through the passages and through the borehole to pivotally attach the fork to the rib. The nose piece extends upward toward the bracket inside of the coil spring to locate the spring. When assembled, the coil spring has a longitudinal axis that forms an acute angle A of greater than zero degrees with an axis of the first support.

In the illustrated embodiments, a pair of parallel ribs 30, 30' protrude from an upper surface of plate portion of the floor platform. The ribs define a pair of aligned boreholes 35, 35' near the front end of the floor platform. The toe assembly upper element forms a hinge wing 32 protruding from an upper surface of the toe assembly. The hinge wing extends to a hinge pin receptacle 33 positioned between the aligned boreholes through the pair of parallel ribs. A hinge pin 34 is positioned through the aligned boreholes and the hinge pin receptacle to retain the toe assembly in proper position with respect to the floor platform. In a preferred embodiment, receptacle 33 is arcuate in a plane transverse to the longitudinal axis of the hinge pin 34. The toe assembly 14 swings around the end of the floor platform to the limits determined by the travel of arcuate receptacle 33 until stopped by hinge pin 34.

The differences between the embodiments shown in FIGS. 1 and 2 is described as follows. In the embodiment of the invention shown in FIG. 1, spring supports 51, 53 and 55, centering rod 57, and capture springs 59 and 61 provide spring biasing of the two vertical support members 10 and 12 into a flexing parallelogram configuration. In the embodiment of the invention shown in FIG. 2, a plurality of cross-braces 236, 236' connect the substantially vertically mounted parallel supports and maintain the parallel supports 210, 212 rigidly in a rectangular configuration together with the floor platform and the shoe platform. The embodiment of the invention shown in FIG. 1 has high utility in the construction/building industry. The embodiment of the invention shown in FIG. 2 has high utility in the entertainment industry.

Another embodiment of the invention provides a pair of stilts with novel pivoting calf braces for greater freedom of movement. Each stilt comprises a floor platform, a shoe platform, a first substantially vertical support, a second substantially vertical support, a first leg support 38, 238 and a calf brace 40, 240 pivotally connected to an upper end portion of the first leg support. The shoe platform is superposed above the floor platform. The first substantially vertical support connects a front portion of the floor platform with a front portion of the shoe platform. The second substantially vertical support connects a back portion of the floor platform with a back portion of the shoe platform. The first and second substantially vertical supports connect the shoe platform and the floor platform in a parallelogram configuration which can be rectangular. The first leg support is mounted to the second substantially vertical support and extends upwardly.

Preferably, a pair of calf braces are employed. The calf brace 40, 240 constitutes a first calf brace and is pivotally mounted to an upper end of the first leg support and is superposed over the shoe platform. A second leg support 42, 242 is mounted to the second substantially vertical support and extends upwardly and a second calf brace 44, 244 is pivotally mounted to an upper of the second leg support and is also superposed over the shoe platform. The calf braces face each other to collar a user's calf during use of the stilts.

Each calf brace is preferably adjustable vertically. In the embodiments shown, leg supports 38, 238 and 42, 242 each have upper and lower sections telescoping together. The calf braces are mounted on the upper sections. Adjustment holes are provided in the upper sections that align with a hole in the lower section to receive a pin to fix height.

Preferably, the calf braces are pivotally mounted to the first and second leg supports to rock back and forth at an angle B of up to 20 degrees from vertical, preferably in the range of 3 degrees to 15 degrees.

Figure 3:
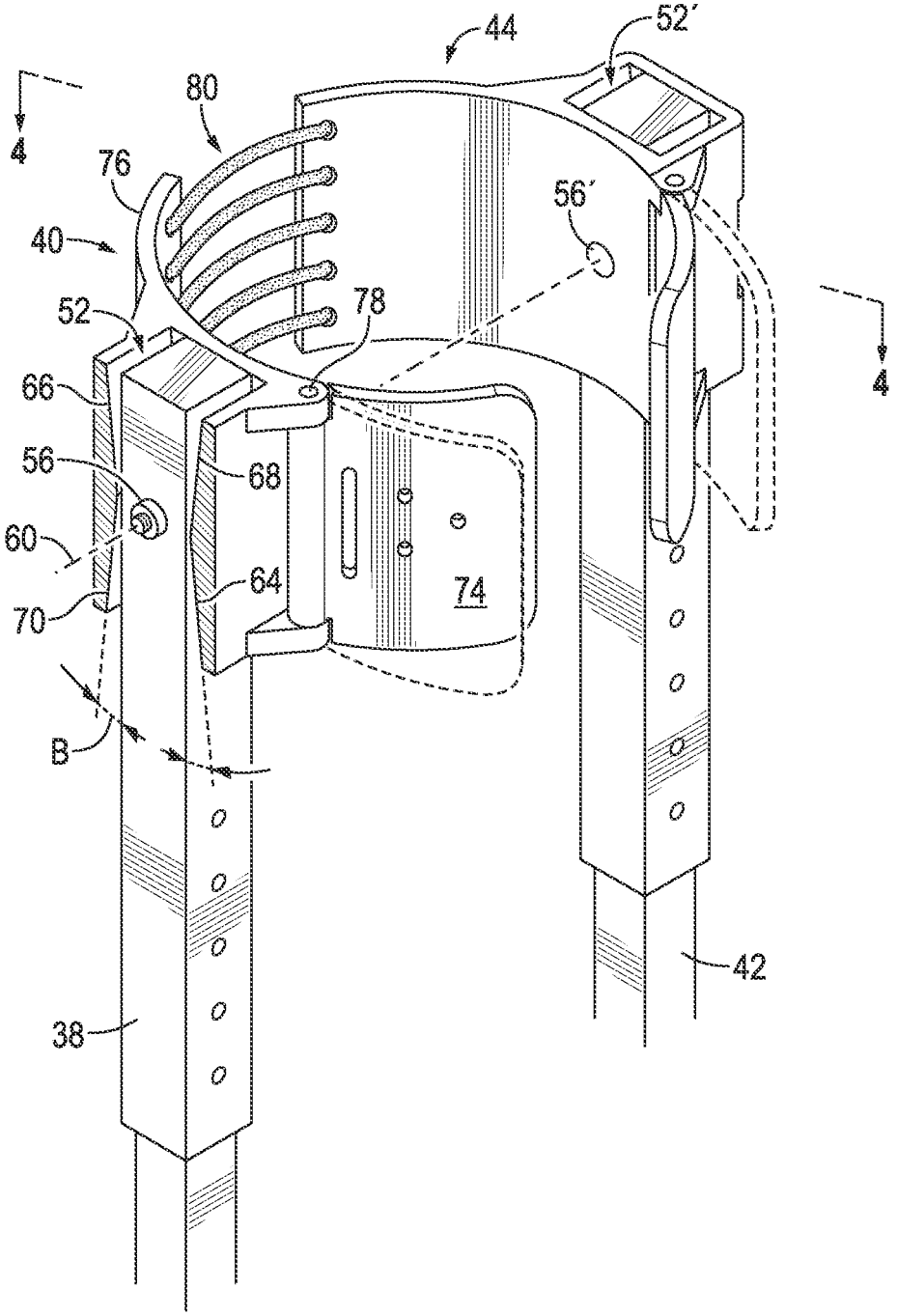
FIG. 3 is a detailed view of a portion of the invention of FIG. 1, illustrating movement with dashed lines.
Figure 4:
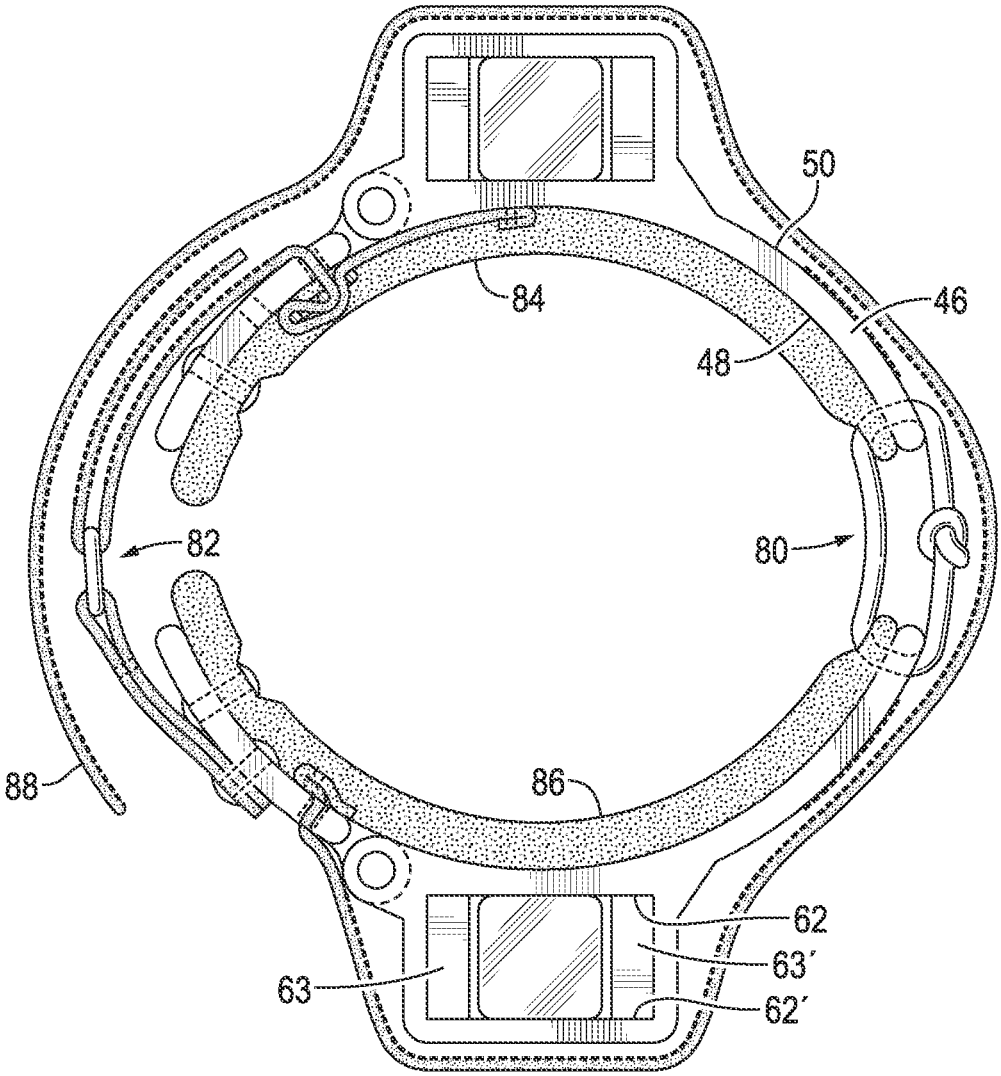
FIG. 4 is a top view of the invention of FIG. 3, when viewed from the perspective of lines 4-4, with added padding features not shown in in FIG. 3.

Referring to FIGS. 3 and 4, preferably each calf brace comprises a band portion 46 that has a concave surface 48 facing towards the other calf brace and a convex surface 50 facing away from the other calf brace. In the illustrated embodiment, each calf brace is formed from plastic and defines a generally vertically oriented capture tunnel 52, 52' mounted an upper end portion of a leg support. The capture tunnel is defined by a longitudinally elongated protrusion protruding from the convex surface. Each vertically oriented capture tunnel has a generally rectangular cross section and a pin 56, 56' extends across each capture tunnel pinning the leg support captured by the tunnel. The pin 56 pinning the first leg support is in general alignment with the pin 56' pinning the second leg support so that the first calf brace and the second calf brace pivot about a common axis 60. The outer wall of each capture tunnel preferably defines a passage 72, 272 to access the pin. See FIGS. 1 and 2.

In a particularly preferred embodiment, each capture tunnel has inner and outer parallel walls 62, 62', and front and back walls 63, 63' that converge toward a center portion of the capture tunnel. The front wall has a lower portion 64 that is parallel to an upper portion 66 of the back wall, and an upper portion 68 that is parallel to a lower portion 70 of the back wall. The upper portion of the back wall and the lower portion of the front wall limits how far the brace half can rock forward by contacting the leg support, and the upper portion of the front wall and the lower portion of the back wall limits how far the brace half can rock backward by contacting the leg support.

Each band portion preferably comprises a front band portion 74 and a back band portion 76. The brace is mounted by the back band portion. The front band portion is connected to the back band portion by a generally vertically oriented hinge 78. The hinged connection facilitates a user putting on the stilts. The back band portion define the generally vertically oriented capture tunnel. The apparatus preferably further comprises a connection system such as lacing system 80 attaching a back edge portion of a first calf brace to a back edge portion of a second calf brace and a closure system 82 adjustably attaching a front edge portion of the first calf brace with a front edge portion of the second calf brace. A first cushion 84 lines the concave surface of the first calf brace and a second cushion 86 lines the concave surface of the second calf brace. A hook-and-loop Velcro type fastener strap 88 having a first end non-releasably secured to a front portion of one of the calf braces and a second end releasably attached to the closure system passes over the lacing system.

While certain preferred embodiments of the invention have been herein described, the invention is not to be construed as being so limited, except to the extent that such limitations are found in the claims.

What is claimed is:

1. An apparatus comprising a floor platform, a shoe platform superposed above the floor platform, a first support connecting a front portion of the floor platform with a front portion of the shoe platform, a second support connecting a back portion of the floor platform with a back portion of the shoe platform, said first and second supports connecting the shoe platform and the floor platform in a parallelogram configuration, a toe assembly hingedly connected to a front end portion of the floor platform and spring-biased for alignment with the floor platform, wherein the toe assembly comprises a sole element and an upper element, said upper element being mounted on a front portion of the sole element, and wherein the floor platform is mounted on a back portion of the sole element, and the sole element is made of a rubbery resilient material.

2. The apparatus as in claim 1 wherein the toe assembly includes a spring mounted to spring-bias the toe assembly into alignment with the floor platform.

3. An apparatus comprising a floor platform, a shoe platform superposed above the floor platform, a first vertical support connecting a front portion of the floor platform with a front portion of the shoe platform, a second vertical support connecting a back portion of the floor platform with a back portion of the shoe platform, said first and second vertical supports connecting the shoe platform and the floor platform in a parallelogram configuration, a toe assembly hingedly connected to a front end portion of the floor platform and biased for alignment with the floor platform, a spring mounted to bias the toe assembly into alignment with the floor platform, and a bracket extending from the first support in superposition with the toe assembly, wherein the spring comprises a coil spring that biases upwardly against the bracket and downwardly against the upper element of the toe assembly.

4. The apparatus as in claim 3 further comprising a pair of parallel ribs protruding from an upper surface of the floor platform, said pair of parallel ribs defining a pair of aligned boreholes near the front end portion of the floor platform, a hinge wing protruding from an upper surface of the toe assembly and defining a hinge pin receptacle positioned between the pair of aligned boreholes, and a hinge pin positioned through the pair of aligned boreholes and the hinge pin receptacle to limit movement of the toe assembly.

5. The apparatus as in claim 4 wherein the hinge pin receptacle is arcuately shaped.

6. An apparatus comprising a floor platform, a shoe platform superposed above the floor platform, a first support connecting a front portion of the floor platform with a front portion of the shoe platform, a second support connecting a back portion of the floor platform with a back portion of the shoe platform, said first and second supports connecting the shoe platform and the floor platform in a parallelogram configuration, a first leg support mounted to the second support and extending upwardly, and a calf brace pivotally mounted to an upper end of the first leg support and superposed over the shoe platform, said calf brace mounted to pivot back and forth at an angle in the range of 3 degrees to 15 degrees with respect to the first leg support.

7. The apparatus as in claim 6 further comprising a second leg support mounted to the second support and extending upwardly, a second calf brace pivotally mounted to an upper end of the second leg support and superposed over the shoe platform, said second calf brace facing the calf brace mounted to the first leg support, said second calf brace mounted to pivot back and forth at an angle in the range of 3 degrees to 15 degrees with respect to the second leg support.

8. An apparatus comprising a floor platform, a shoe platform superposed above the floor platform, a first vertical support connecting a front portion of the floor platform with a front portion of the shoe platform, a second vertical support connecting a back portion of the floor platform with a back portion of the shoe platform, said first and second vertical supports connecting the shoe platform and the floor platform in a parallelogram configuration, a first leg support mounted to the second vertical support and extending upwardly, a calf brace pivotally mounted to an upper end of the first leg support and superposed over the shoe platform, a second leg support mounted to the second vertical support and extending upwardly, a second calf brace pivotally mounted to an upper end of the second leg support and superposed over the shoe platform, said second calf brace facing the calf brace mounted to the first leg support, wherein the calf brace and the second calf brace each define a vertically oriented capture tunnel and are pivotally mounted by the vertically oriented capture tunnels to the respective first leg support and second leg support, to permit the calf brace and the second calf brace to rock back and forth at an angle of up to 20 degrees from vertical.

9. The apparatus as in claim 8 wherein each of the vertically oriented capture tunnels has a rectangular cross section in a horizontal plane, said apparatus further comprising a pin extending across each of the vertically oriented capture tunnels pinning the respective first leg support and second leg support to the respective vertically oriented capture tunnel, each of the pins pinning each of the respective first and second leg support in alignment with each other so that the calf brace and the second calf brace pivot about a common axis.

10. The apparatus as in claim 9 wherein each of the vertically oriented capture tunnels has inner and outer parallel walls, and front and back walls that converge toward a center portion of the respective vertically oriented capture tunnel, wherein the front wall has a lower portion that is parallel to an upper portion of the back wall, and an upper portion that is parallel to a lower portion of the back wall.

11. The apparatus as in claim 10 wherein the upper portion of the back wall and the lower portion of the front wall limits how far the calf brace and the second calf brace is configured to rock forward by contacting the leg support, and the upper portion of the front wall and the lower portion of the back wall limits how far the calf brace and the second calf brace is configured to rock backward by contacting the leg support.

12. The apparatus as in claim 11 further comprising a first cushion lining a concave surface of the calf brace mounted to the first leg support and a second cushion lining a concave surface of the second calf brace.

13. The apparatus as in claim 12 further comprising a hook-and-loop fastener strap having a first end non-releasably secured to a front portion of one of the calf brace and the second calf brace and a second end releasably attached to the closure system, said hook-and-loop fastener strap passing over a lacing system.

14. A calf brace for a stilt, said calf brace comprising a band that has a concave surface and a convex surface and defining a capture tunnel, said capture tunnel having a cross section with inner and outer parallel walls and front and back walls that converge toward a center portion of the capture tunnel, the front wall having a lower portion that is parallel to an upper portion of the back wall, and an upper portion that is parallel to a lower portion of the back wall.

15. A calf brace for a stilt, said calf brace comprising a band that has a concave surface and a convex surface and defining a vertically oriented capture tunnel, said vertically oriented capture tunnel having a rectangular cross section with inner and outer parallel walls and front and back walls that converge toward a center portion of the capture tunnel, the front wall having a lower portion that is parallel to an upper portion of the back wall, and an upper portion that is parallel to a lower portion of the back wall, wherein the band comprises a front band portion and a back band portion, the front band portion being connected to the back band portion by a vertically oriented hinge, the back band portion defining the vertically oriented capture tunnel, the outer wall of the capture tunnel defining a passage to access the tunnel.

* * * * *